US007742000B2

(12) United States Patent
Mohamadi

(10) Patent No.: US 7,742,000 B2
(45) Date of Patent: Jun. 22, 2010

(54) CONTROL OF AN INTEGRATED BEAMFORMING ARRAY USING NEAR-FIELD-COUPLED OR FAR-FIELD-COUPLED COMMANDS

(75) Inventor: Farrokh Mohamadi, Irvine, CA (US)

(73) Assignee: Tialinx, Inc., Irvine, CA (US)

( * ) Notice: Subject to any disclaimer, the term of this patent is extended or adjusted under 35 U.S.C. 154(b) by 781 days.

(21) Appl. No.: 11/550,789

(22) Filed: Oct. 18, 2006

(65) Prior Publication Data

US 2007/0080888 A1 Apr. 12, 2007

Related U.S. Application Data

(63) Continuation-in-part of application No. 11/182,344, filed on Jul. 15, 2005, now Pat. No. 7,321,339, which is a continuation-in-part of application No. 11/141,283, filed on May 31, 2005, now Pat. No. 7,312,763.

(60) Provisional application No. 60/728,416, filed on Oct. 18, 2005.

(51) Int. Cl.
*H01Q 1/38* (2006.01)

(52) U.S. Cl. ..... 343/700 MS; 343/853

(58) Field of Classification Search ..... 343/700 MS, 343/772, 795, 853
See application file for complete search history.

(56) References Cited

U.S. PATENT DOCUMENTS

| | | | | |
|---|---|---|---|---|
| 6,870,503 | B2 | 3/2005 | Mohamadi | |
| 6,885,344 | B2 | 4/2005 | Mohamadi | |
| 6,982,670 | B2 | 1/2006 | Mohamadi | |
| 7,042,388 | B2 | 5/2006 | Mohamadi | |
| 7,126,554 | B2 | 10/2006 | Mohamadi | |
| 2004/0095277 | A1 * | 5/2004 | Mohamadi | 343/700 MS |
| 2005/0057421 | A1 | 3/2005 | Mohamadi | |
| 2005/0116864 | A1 * | 6/2005 | Mohamadi | 343/700 MS |
| 2005/0151698 | A1 * | 7/2005 | Mohamadi | 343/795 |
| 2005/0156789 | A1 * | 7/2005 | Mohamadi | 343/700 MS |
| 2005/0169319 | A1 | 8/2005 | Mohamadi | |

* cited by examiner

*Primary Examiner*—HoangAnh T Le
(74) *Attorney, Agent, or Firm*—Haynes & Boone, LLP.

(57) ABSTRACT

In one embodiment, an integrated circuit antenna array includes: a substrate, a plurality of first antennas adjacent a first side of the substrate; and an RF network adjacent a second side of the substrate, the RF feed network coupling to a distributed plurality of amplifiers integrated with the substrate and to a distributed plurality of phase-shifters also integrated with the substrate, each phase shifter being associated with a receptor to receive a beam-forming command, wherein each receptor is configured to receive the beam-forming command through either a near-field coupling or a far-field coupling.

15 Claims, 14 Drawing Sheets

CONTROL OF AN INTEGRATED BEAMFORMING ARRAY USING NEAR-FIELD-COUPLED OR FAR-FIELD-COUPLED COMMANDS

RELATED APPLICATIONS

This application is a continuation-in-part of U.S. application Ser. No. 11/182,344, filed Jul. 15, 2005 now U.S. Pat. No. 7,321,339, which in turn is a continuation-in-part of U.S. application Ser. No. 11/141,283, filed May 31, 2005 now U.S. Pat. No. 7,312,763. In addition, this application claims the benefit of U.S. Provisional Application No. 60/728,416, filed Oct. 18, 2005.

STATEMENT REGARDING FEDERALLY SPONSORED RESEARCH OR DEVELOPMENT

This invention was made with Government support under contract number FA9453-06-C-0037 awarded by the U.S. Air Force. The U.S. Air Force and DARPA have certain rights in this invention.

TECHNICAL FIELD

The present disclosure relates generally to integrated beamforming arrays and more particularly to the control of an integrated beamforming array.

BACKGROUND

U.S. patent application Ser. Nos. 11/182,344 and 11/141,283 disclose an integrated beamforming array that may be denoted as a "wafer scale antenna module" in that the antennas, beamforming electronics such as phase-shifters or amplitude-shifters, and feed network may all be integrated with a wafer scale semiconductor substrate. In these wafer scale antenna modules, an RF signal to be transmitted is driven into the feed network, which may be a co-planar waveguide (CPW) network or any other suitable transmission network. Distributed amplifiers within the feed network provide high gain to the transmitted RF signal, which may then be phase-shifted and/or amplitude-shifted such that a resulting RF signal propagated from the antennas coupled to the feed network is steered in a desired direction. Alternatively, the distributed amplifiers within the transmission network may form a distributed oscillator as discussed in U.S. application Ser. No. 11/536,625, filed Sep. 28, 2006, the contents of which are incorporated by reference. A received RF signal from the antennas arrayed on the wafer scale semiconductor substrate may be similarly phase-shifted and/or amplitude-shifted as desired and driven using distributed amplification through the same feed network used for transmission or a separate receive network. Because the resulting beam steering is electronically controlled yet formed using conventional semiconductor processes, such wafer scale antenna modules offer low cost design yet achieve state of the art gain and beam steering performance. Moreover, because the attached IF or baseband processing stage sees a single RF port (for either transmission or reception), only a single analog-to-digital converter is necessary. In contrast, conventional beamforming systems perform their beam steering in the IF or baseband domain which thus requires multiple channels be maintained in these domains. For example, suppose the antenna array is controlled in quadrants such that a first quadrant is to have a first phase, a second quadrant to have a second phase, and so on. A baseband or IF beam steering system must then have four channels supported for these four phases, thereby requiring four analog-to-digital converters. At high data rates, such systems must then perform massively parallel analog-to-digital conversion, which is expensive or simply unachievable at high data rates.

A similar wafer scale approach is disclosed, for example, in U.S. Pat. No. 6,982,670, the contents of which are incorporated by reference. In this approach, the semiconductor substrate includes a plurality of integrated antenna circuits. Each integrated antenna circuit includes an oscillator coupled to one or more antennas. Thus, in such a wafer scale approach there is no need for the complication of a feed network with distributed amplification because the RF signal is being generated locally within each integrated antenna circuit. However, the integrated antenna circuits need to be synchronized to each other. This synchronization may occur through reception at each integrated antenna circuit of a synchronizing signal from an integrated waveguide such as disclosed in U.S. application Ser. No. 11/536,625, filed Sep. 28, 2006, the contents of which are incorporated by reference.

Regardless of whether a wafer scale antenna module is formed using an RF feed network with distributed amplification or an array of integrated antenna circuits having oscillators, the beamforming commands need to be distributed to the phase-shifters and/or amplitude shifters that are integrated into the semiconductor substrate. These commands may be distributed across the substrate using photolithography to form appropriate conductive traces, but such traces complicate the circuit layout and may interfere electromagnetically with other signal distributions. To avoid such complications, a command distribution scheme that may be denoted as a "coupling array mesh" was disclosed in U.S. Pat. No. 6,870,670 that may electromagnetically couple through, for example, the far field. However, a far field coupling requires an antenna array to receive the beamforming commands (and also synchronization signals in the case of an integrated antenna circuit WSAM embodiment).

Accordingly, there is a need in the art for improved wafer scale antenna module beamforming command distribution schemes.

SUMMARY

In accordance with an aspect of the invention, an integrated circuit antenna array is provided that includes: a substrate; a plurality of first antennas adjacent a first side of the substrate; and an RF network adjacent a second side of the substrate, the RF feed network coupling to a distributed plurality of amplifiers integrated with the substrate and to a distributed plurality of phase-shifters also integrated with the substrate, each phase shifter being associated with a receptor to receive a beam-forming command, wherein each receptor is configured to receive the beam-forming command through either a near-field coupling or a far-field coupling.

In accordance with an aspect of the invention, an integrated circuit antenna array is provided that includes: a semiconductor substrate having a first surface and an opposing second surface; a plurality of heavily-doped contact regions extending from the first surface to the second surface; a plurality of antennas formed on an insulating layer adjacent the first surface, each antenna being coupled to corresponding ones of the contact regions by vias; driving circuitry formed on the second surface of the substrate, wherein the driving circuitry is configured such that each antenna corresponds to a oscillator, each oscillator being coupled to a receptor configured to receive a beamforming command through either a near-field coupling or a far-field coupling.

The invention will be more fully understood upon consideration of the following detailed description, taken together with the accompanying drawings.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Reference will now be made in detail to one or more embodiments of the invention. While the invention will be described with respect to these embodiments, it should be understood that the invention is not limited to any particular embodiment. On the contrary, the invention includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

The present invention provides a wafer scale antenna module in which the beamforming commands are distributed using either near-field coupling or far-field coupling. Because near-field coupling has certain advantages over far-field coupling, a near-field coupled command distribution scheme will be described first. Regardless of whether a near-field or far-field distribution scheme is implemented, the approach may be applied to a wafer scale antenna module (WSAM). As discussed previously, a WSAM may be implemented using a feed network having distributed amplification or an array of integrated antenna circuits that each include an oscillator. A WSAM having a feed network with distributed amplification will be discussed first.

Figure 1:
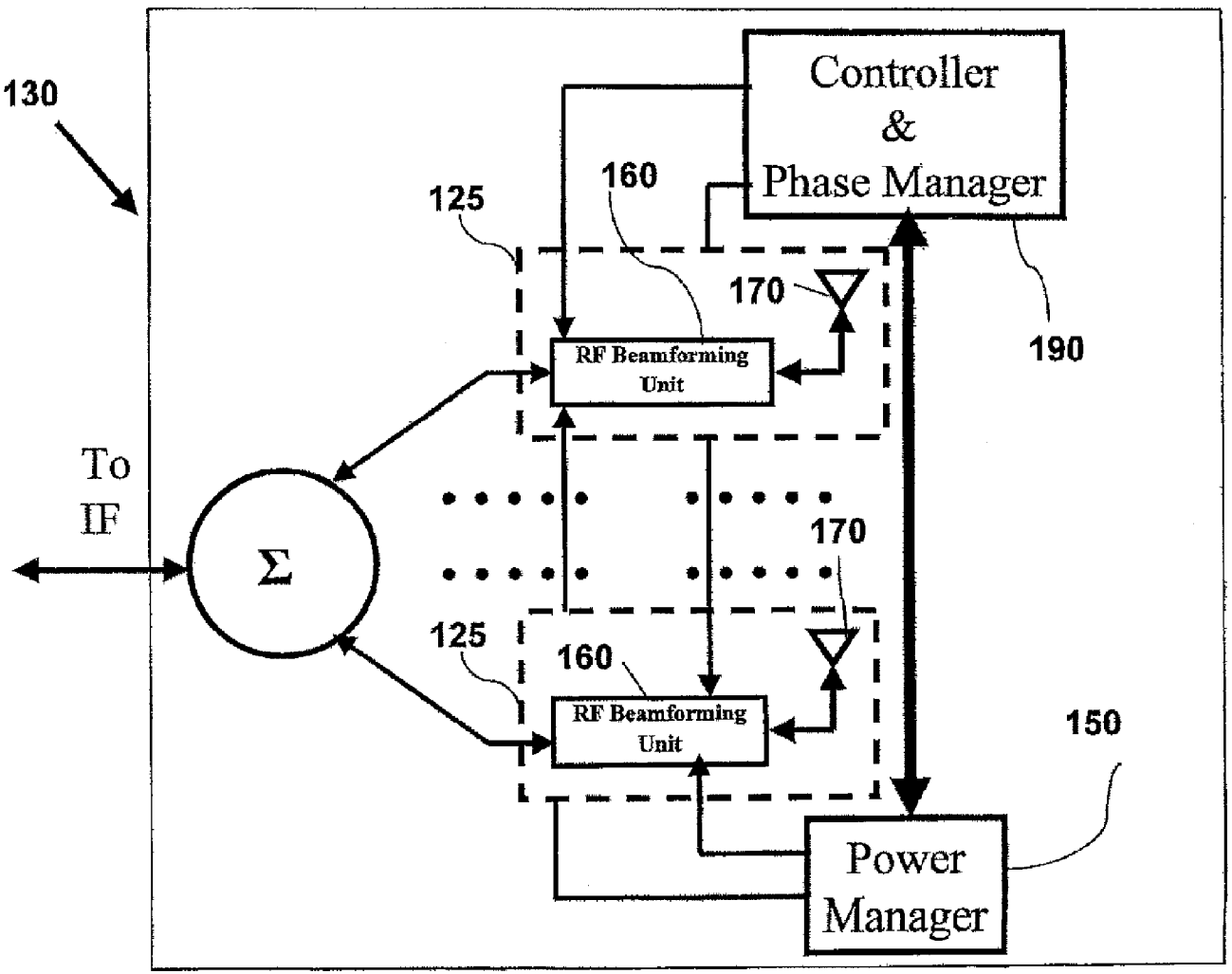
FIG. 1 is a block diagram of a beamforming antenna array in which the beamforming is performed in the RF domain.

An exemplary embodiment of such a wafer scale beamforming approach may be better understood with regard to the beamforming system of FIG. 1, which illustrates an integrated RF beamforming and controller unit 130. In this embodiment, the receive and transmit antenna arrays are the same such that each antenna 170 functions to both transmit and receive. A plurality of integrated antenna circuits 125 each includes an RF beamforming interface circuit 160 and receive/transmit antenna 170. RF beamforming interface circuit 160 adjusts the phase and/or the amplitude of the received and transmitted RF signal responsive to control from a controller/phase manager circuit 190. Although illustrated having a one-to-one relationship between beamforming interface circuits 160 and antennas 170, it will be appreciated, however, that an integrated antenna circuit 125 may include a plurality of antennas all driven by RF beamforming interface circuit 160.

Figure 2:
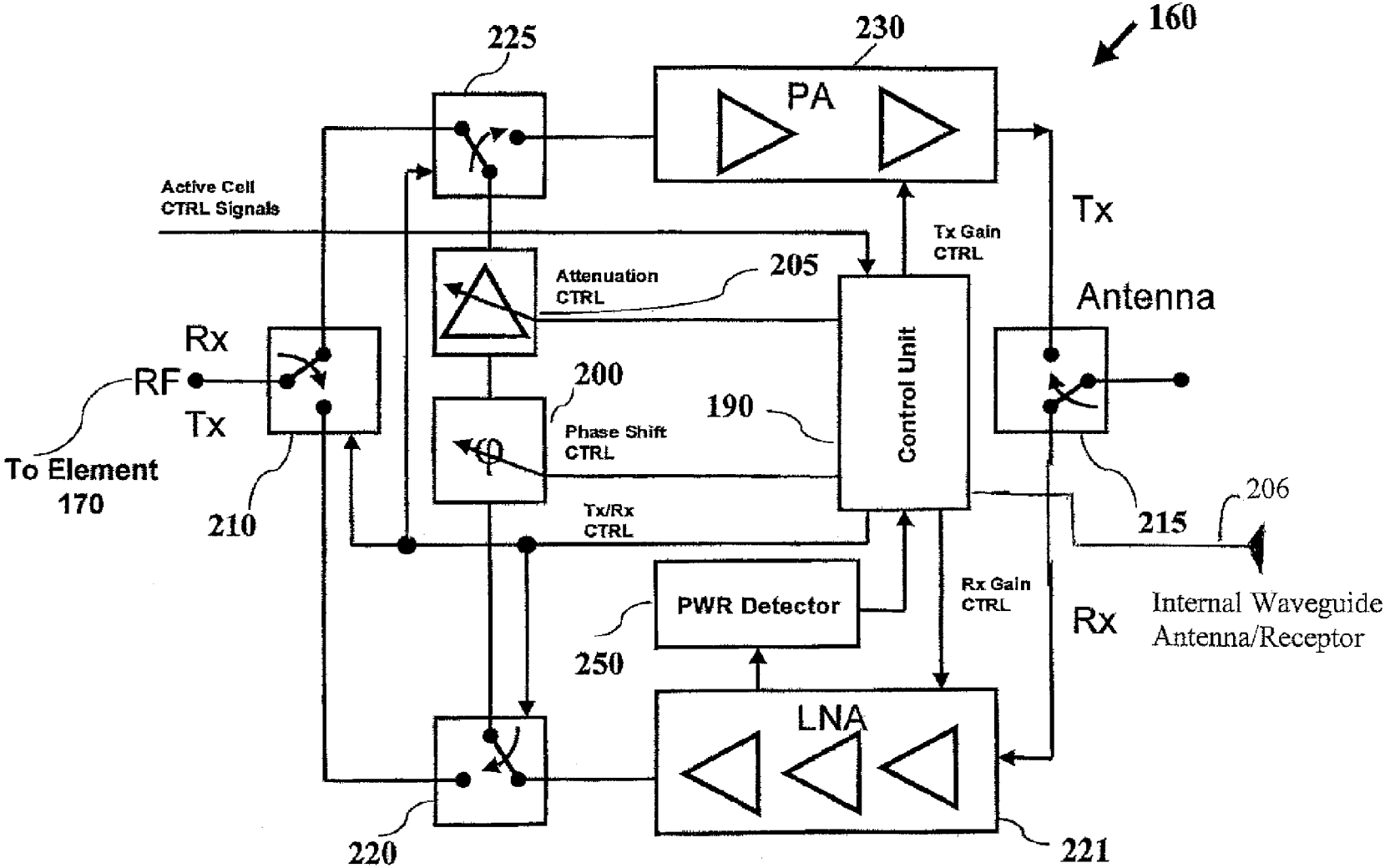
FIG. 2 is a schematic illustration of an RF beamforming interface circuit for the array of FIG. 1.

A circuit diagram for an exemplary embodiment of RF beamforming interface circuit 160 is shown in FIG. 2. Note that the beamforming performed by beamforming circuits 160 may be performed using either phase shifting, amplitude variation, or a combination of both phase shifting and amplitude variation. Accordingly, RF beamforming interface circuit 160 is shown including both a variable phase shifter 200 and a variable attenuator 205. It will be appreciated, however, that the inclusion of either phase shifter 200 or attenuator 205 will depend upon the type of beamforming being performed. To provide a compact design, RF beamforming circuit may include RF switches/multiplexers 210, 215, 220, and 225 so that phase shifter 200 and attenuator 205 may be used in either a receive or transmit configuration. For example, in a receive configuration RF switch 215 routes the received RF signal to a low noise amplifier 221. The resulting amplified signal is then routed by switch 220 to phase shifter 200 and/or attenuator 205. The phase shifting and/or attenuation provided by phase shifter 200 and attenuator 205 are under the control of controller/phase manager circuit 190. The resulting shifted signal routes through RF switch 225 to RF switch 210. RF switch 210 then routes the signal to IF processing circuitry (not illustrated).

In a transmit configuration, the RF signal received from IF processing circuitry (alternatively, a direct down-conversion architecture may be used to provide the RF signal) routes through RF switch 210 to RF switch 220, which in turn routes the RF signal to phase shifter 200 and/or attenuator 205. The resulting shifted signal is then routed through RF switch 225 to a power amplifier 230. The amplified RF signal then routes through RF switch 215 to antenna 170 (FIG. 1). It will be appreciated, however, that different configurations of switches may be implemented to provide this use of a single set of phase-shifter 200 and/or attenuator 205 in both the receive and transmit configuration. In addition, alternate embodiments of RF beamforming interface circuit 160 may be constructed not including switches 210, 220, and 225 such that the receive and transmit paths do not share phase shifter 200 and/or attenuator 205. In such embodiments, RF beamforming interface circuit 160 would include separate phase-shifters and/or attenuators for the receive and transmit paths.

To assist the beamforming capability, a power detector 250 functions as a received signal strength indicator to measure the power in the received RF signal. For example, power detector 250 may comprise a calibrated envelope detector. As seen in FIG. 1, a power manager 150 may detect the peak power determined by the various power detectors 250 within each integrated antenna circuit 125. The integrated antenna circuit 125 having the peak detected power may be denoted as the "master" integrated antenna circuit. Power manager 150 may then determine the relative delays for the envelopes for the RF signals from the remaining integrated antenna circuits 125 with respect to the envelope for the master integrated antenna circuit 125. To transmit in the same direction as this received RF signal, controller/phase manager 190 may determine the phases corresponding to these detected delays and command the transmitted phase shifts/attenuations accordingly. Alternatively, a desired receive or transmit beamforming direction may simply be commanded by controller/phase manager 190 rather than derived from a received signal. In such embodiment, power managers 150 and 250 need not be included since phasing information will not be derived from a received RF signal.

Regardless of whether integrated antenna circuits 125 perform their beamforming using phase shifting and/or amplitude variation, the shifting and/or variation is performed on the RF signal received either from the IF stage (in a transmit mode) or from its antenna 170 (in a receive mode). By performing the beamforming directly in the RF domain as discussed with respect to FIGS. 1 and 2, substantial savings are introduced over a system that performs its beamforming in the IF or baseband domain. Such IF or baseband systems must include A/D converters for each RF channel being processed. In contrast, the system shown in FIG. 1 may supply a combined RF signal from an adder 140. From an IF standpoint, it is just processing a single RF channel for the system of FIG. 1, thereby requiring just a single A/D. Accordingly, the following discussion will assume that the beamforming is performed in the RF domain. The reception of phase and/or attenuation control signals to controller/phase manager circuit 190 into each integrated antenna circuit 125 may be received over an internal waveguide antenna/receptor 206 as will be described further herein.

Figure 3:
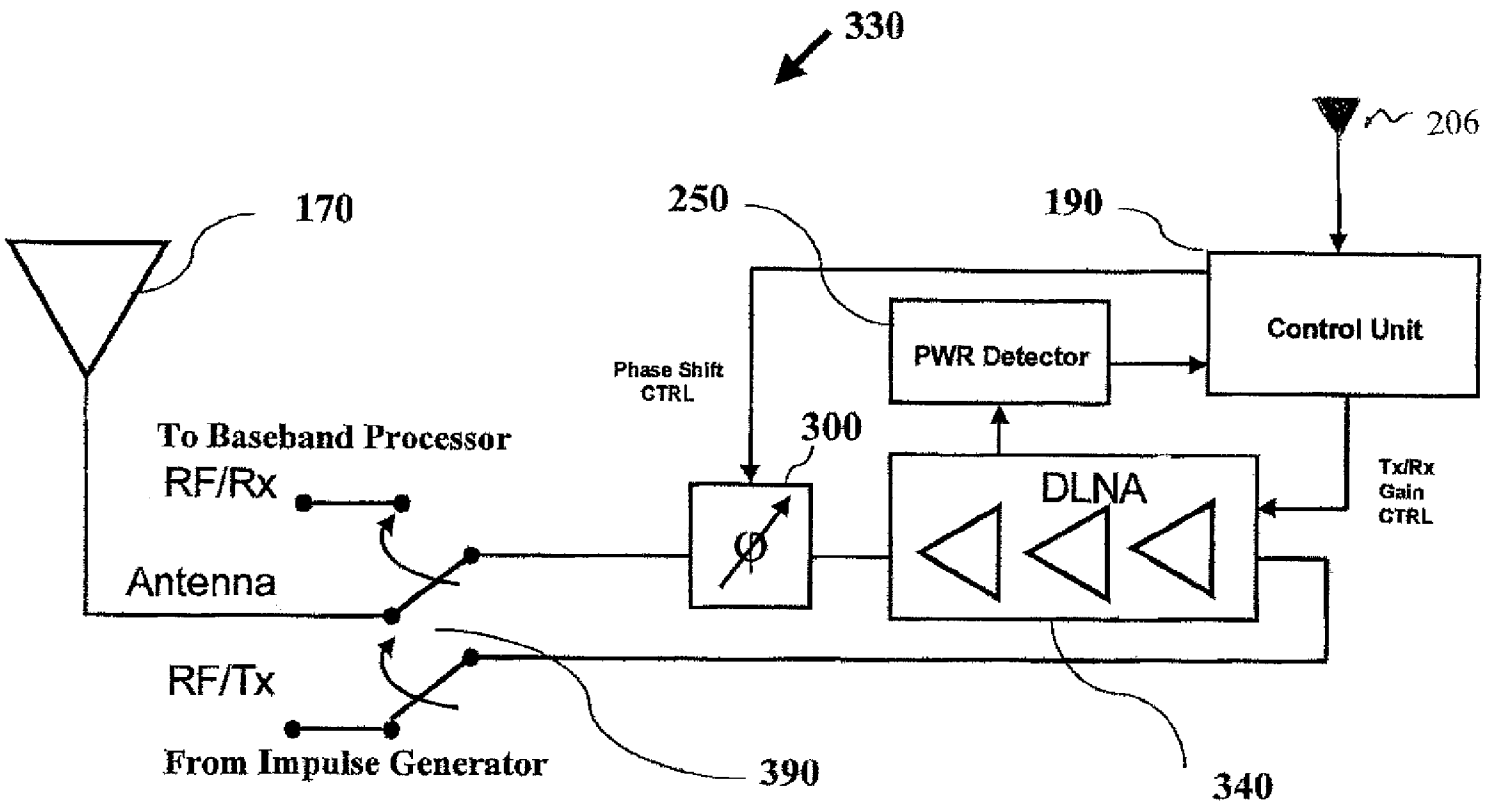
FIG. 3 is a high-level schematic illustration of an RF beamforming interface circuit including a distributed phase shifter and a distributed amplifier in accordance with an embodiment of the invention.
Figure 4:
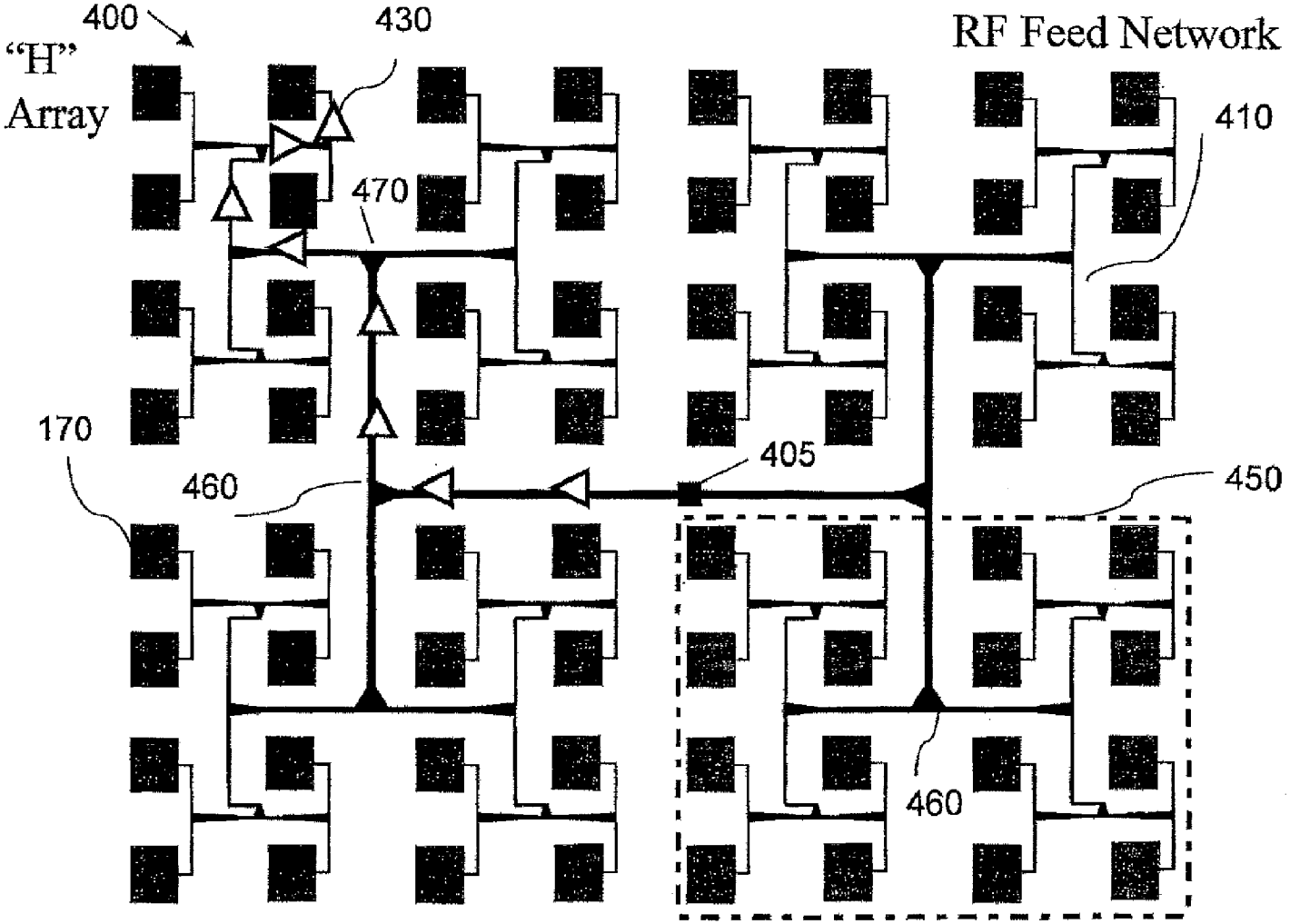
FIG. 4 is a plan view of a wafer scale beamforming antenna array module and its associated transmission network in accordance with an embodiment of the invention.
Figure 5:
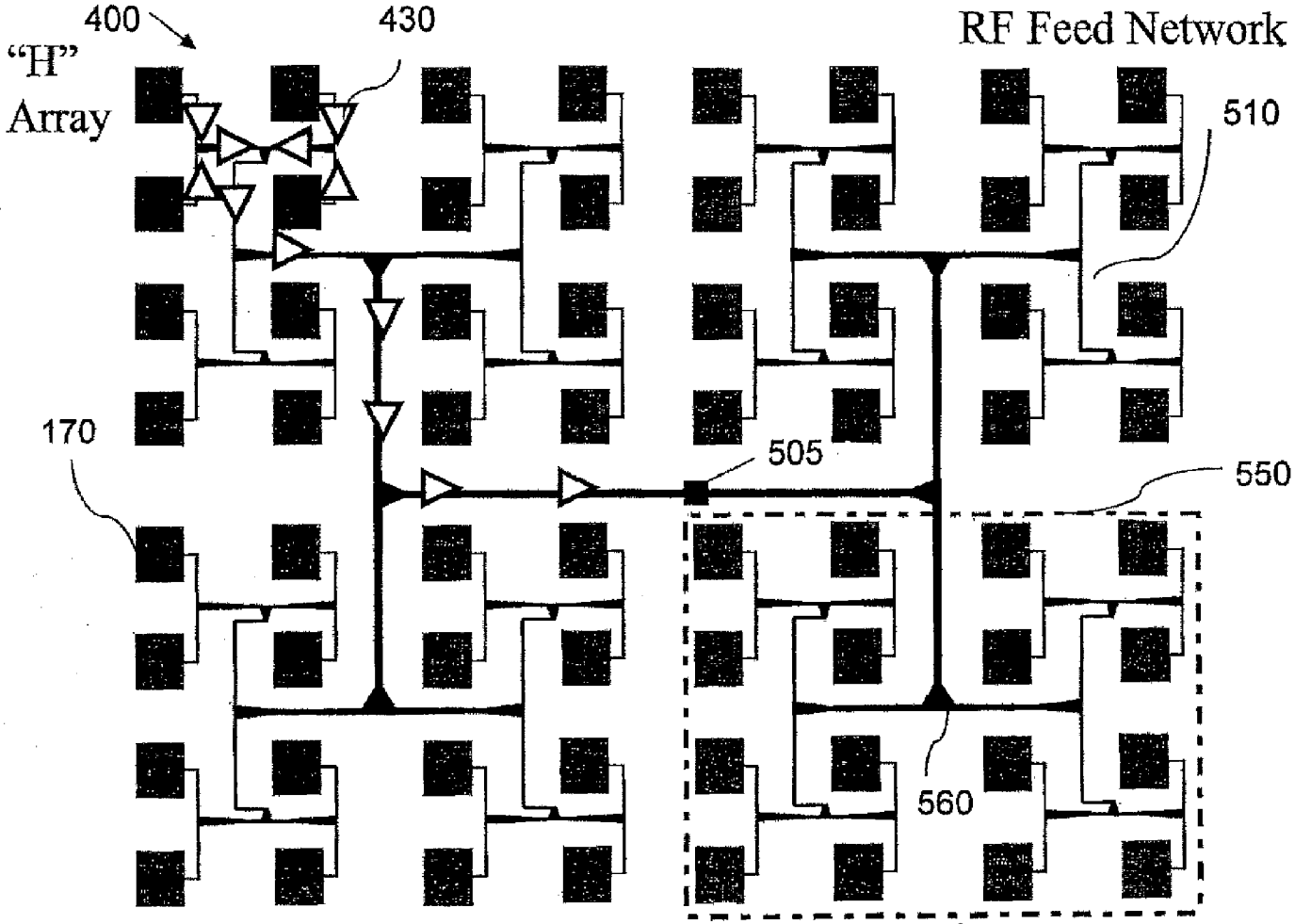
FIG. 5 is a plan view of a wafer scale beamforming antenna array module and its associated receiving network in accordance with an embodiment of the invention.

Referring now to FIG. 3, another exemplary embodiment of an RF beamforming interface circuit is illustrated. In this embodiment, signals are distributed between a baseband processor and the antennas using a coplanar waveguide network 330, which may be either full-duplex or half-duplex. In the embodiment illustrated in FIG. 3, CPW network 330 is half-duplex. However, it will be appreciated that the full-duplex arrangement may also be used. To accommodate half-duplex transmission, RF switches 390 select for either a receiving or transmitting mode. In the transmitting mode, the baseband processor provides an RF signal to distributed low noise amplifier (DLNA) 340. In turn, DLNA 340 provides its amplified signal to a discrete phase shifter 300 so that the amplified signal may be phase shifted according to commands from control unit 190. In the receiving mode, RF switches 390 are configured so that a received RF signal from antenna 170 couples through DLNA 340 and phase shifter 300 to the baseband processor. As discussed earlier, a power detector 250 may be used to determine the "master" antenna based upon received power for beam steering purposes The CPW network and antennas may advantageously be implemented in a wafer scale antenna module. A view of an 8" wafer scale antenna module 400 having 64 antenna elements 170 is illustrated in FIGS. 4 and 5. A half-duplex transmission network 410 is illustrated in FIG. 4. From a center feed point 405, transmission network 410 couples to every antenna element 170. For such an array, the transmission distance from feed point 405 to any given antenna element may be approximately 120 mm, which is close to four wavelengths at 10 GHz. Should network 410 be implemented using CPW, the transmission losses can thus exceed 120 dB. Although the scope of the invention includes the use of any suitable architecture for network 410 such as CPW, microstrip, and planar waveguide, CPW enjoys superior shielding properties over microstrip. Thus, the following discussion will assume without loss of generality that network 410 is implemented using CPW. A half-duplex receiving CPW network 510 for wafer scale antenna module 400 having 64 antenna elements 170 is illustrated in FIG. 5.

The transmission network may be single-ended or differential. In one embodiment, the network may comprise a coplanar waveguide (CPW) having a conductor width of a few microns (e.g., 4 microns). With such a small width or pitch to the network, a first array of 64 antenna elements and a second array of 1024 antenna elements may be readily networked in an 8 inch wafer substrate for 10 GHz and 40 GHz operation, respectively. Alternatively, a wafer scale antenna module may be dedicated to a single frequency band of operation. Referring back to FIG. 2 and 3, it may be seen that there need not be a one-to-one relationship between a distributed phase shifter 300 (alternatively, a beamforming circuit 160) and an antenna 170. Instead, the relationship depends upon the granularity of control desired. Clearly, the greatest control occurs when each antenna shown in FIGS. 4 and 5, for example, can be individually phased with regard to each other. However, that requires substantial die area and associated costs. Thus, a simpler design would have a distributed phase-shifter 300 control a subset of the antennas. For example, the array shown in FIG. 4 could be divided into quadrants such that each quadrant has its own distributed phase-shifter. Further details regarding an advantageous analog distributed phase-shifter can be found in U.S. patent application Ser. No. 11/535,928, filed Sep. 27, 2006, the contents of which are incorporated by reference.

The design of the distributed amplifiers is not critical so long as they provide sufficient amplification. As set forth in U.S. application Ser. No. 11/182,344, the distributed amplifiers may comprise driving amplifier and matching amplifier pairs whose gains are tuned using integrated inductors. The driving amplifier provides gain into a section of the transmission network received by a matching amplifier that matches the driving amplifier to the characteristic impedance of the transmission network. These amplifiers are biased to operate in the small signal linear domain. Rather than drive the transmission network with an RF signal that is then linearly amplified and received at the various integrated antenna circuits, an alternative approach is disclosed in U.S. patent application Ser. No. 11/536,625, filed Sep. 28, 2006, the contents of which are incorporated by reference. In this approach, the distributed amplifiers are designed and driven to achieve a resonant operation with the transmission network in response to the injection of a timing signal. Thus, it will be appreciated that the distributed amplifiers may comprise the driving/matching amplifiers described earlier or alternative distributed amplifiers may be used. In one embodiment, a driving amplifier in the receiving and transmission networks is followed by a matching amplifier for efficient performance.

Figure 6:
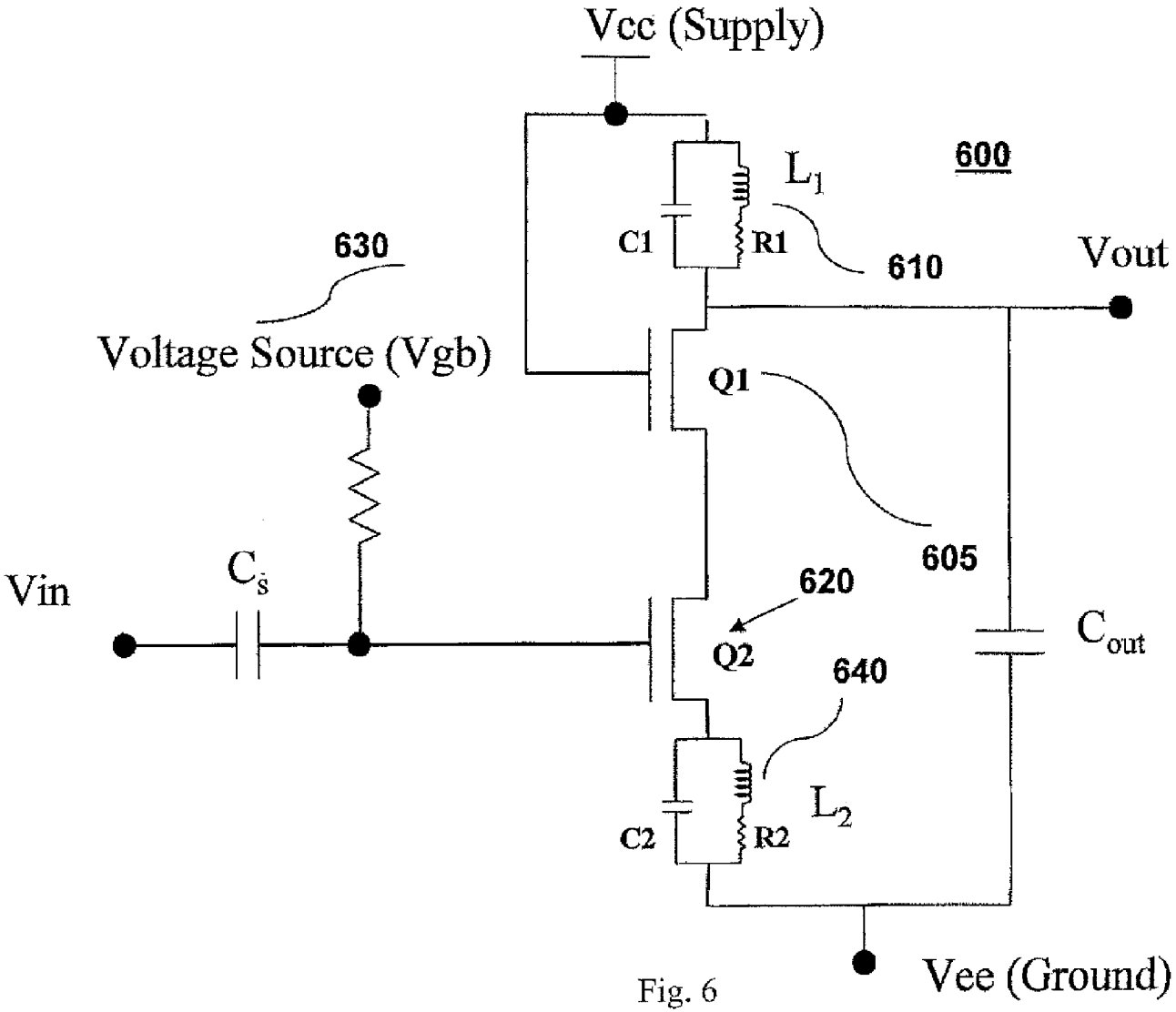
FIG. 6 is a schematic illustration of a matching amplifier in accordance with an embodiment of the invention.
Figure 7:
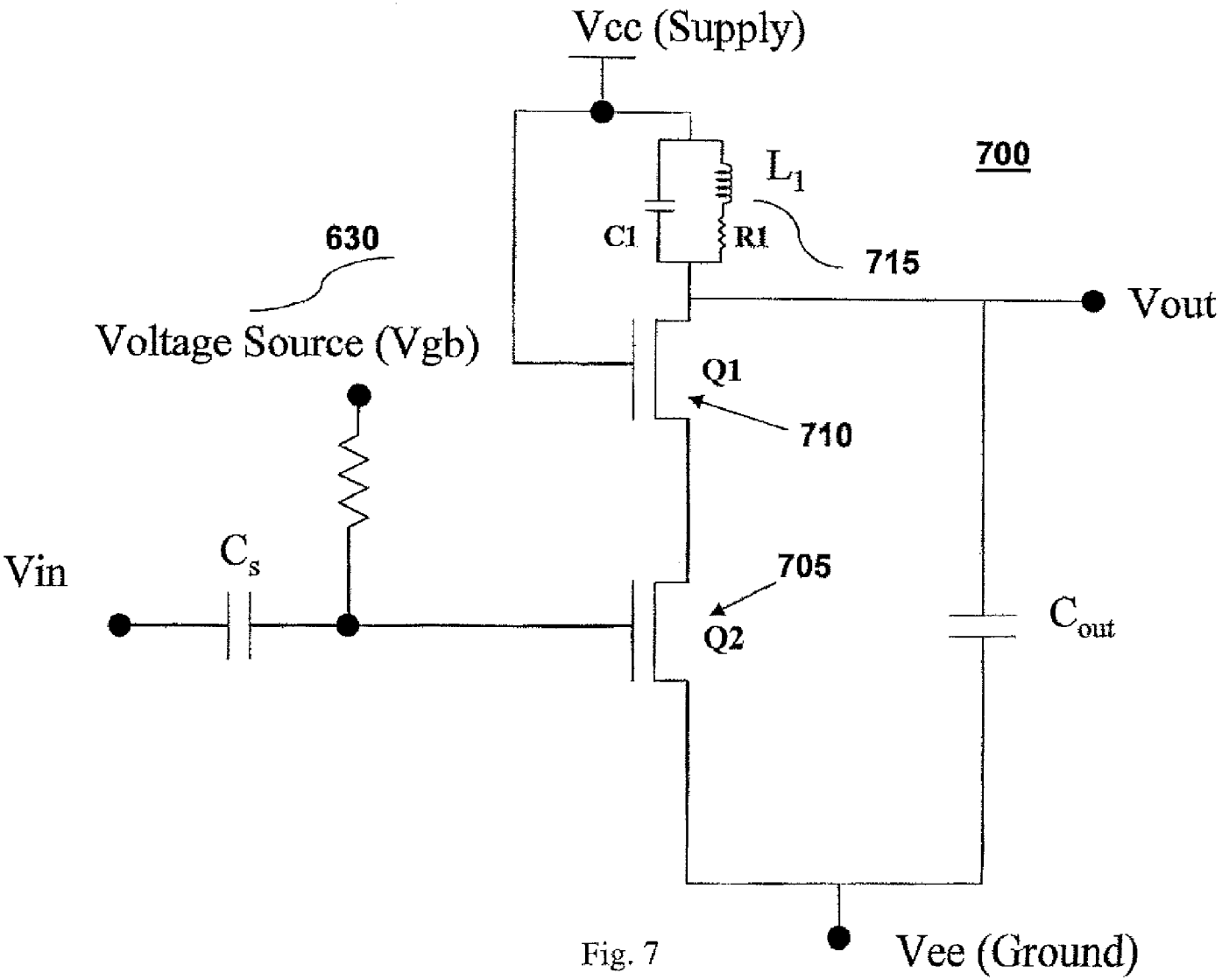
FIG. 7 is a schematic illustration of a driving amplifier for distributed amplification in accordance with an embodiment of the invention.

An exemplary embodiment of a FET-based matching amplifier 600 is illustrated in FIG. 6. Matching amplifier 600 couples to a coplanar waveguide network (not illustrated) at input port Vin and output port Vout. An analogous BJT-based architecture may also be implemented. The FETs may be either NMOS or PMOS. A first NMOS FET Q1 605 has its source coupled through an integrated inductor (L1) 610 to a supply voltage Vcc. This integrated inductor L1 may be formed using metal layers in a semiconductor process as discussed in commonly-assigned U.S. Pat. No. 6,963,307, the contents of which are incorporated by reference. Because such an integrated inductor L1 will also have a stray capacitance and resistance, these stray effects are modeled by capacitor C1 and resistor R1. The metal layers in the semiconductor process may also be used to form a DC blocking capacitor $C_s$ and an output capacitor $C_{out}$. The supply voltage also biases the gate of Q1. Q1 has its drain driving Vout and its source coupled to a second NMOS FET Q2 620. A voltage source 630 coupled through a high value resistor or configured transistor biases the gate of Q2 620 with a voltage Vgb (whereas in a BJT embodiment, the base of Q1 is biased by a current source). The source of Q2 620 couples to ground through an integrated inductor (L2) 640. Analogous to inductor 610, inductor 640 has its stray capacitance and resistance modeled by capacitor C2 and resistor R2. It may be shown that an input resistance Rin for amplifier 600 is as follows:

$$Rin=(gm)*L2/Cgs$$

where gm is the transconductance for Q2 620, L2 is the inductance of the inductor 640 and Cgs is the gate-source capacitance for Q2 620. Thus, Q2 620 and inductor 640 characterize the input impedance and may be readily designed to present a desired impedance. For example, if an input resistance of 50Ω is desired (to match a corresponding impedance of the CPW network), the channel dimensions for Q2 and dimensions for inductor 640 may be designed accordingly. The gain of matching amplifier 600 is proportional to the inductance of L1.

An exemplary driving amplifier 700 is illustrated in FIG. 6. Driving amplifier 700 is constructed analogously to matching amplifier 600 except that no inductor loads the source of Q2 705 (alternatively, an inductor having a fraction to 1/10 the inductance of L1 may load the source of Q2). The gain of driving amplifier 700 is proportional to the inductance of L1. A transistor Q1 710 has its drain loaded with integrated inductor L1 715 in a similar fashion as discussed with regard to Q1 605 of matching amplifier 600. Inductor 715 determines a center frequency Fd for driving amplifier 700 whereas both inductors 640 and 610 establish a resonant frequency Fm for matching amplifier 600. It may be shown that the band-pass center frequency Fc of a series-connected driving and matching amplifier is given as $$Fc=\tfrac{1}{2}*sqrt(Fd^2+Fm^2)$$

Referring back to FIG. 4, a series of driving amplifier/matching amplifier pairs 430 are shown coupling feed point 405 to a first network intersection 460. In such an "H" configured network array, network 410 will continue to branch from intersection 460 such as at an intersection 470. For a half-duplex embodiment, driving amplifier/matching amplifier pairs 430 may also be incorporated in receiving network 510 as seen in FIG. 5. For illustration clarity, the distribution of the driving amplifier/matching amplifier pairs 430 is shown only in selected transmission paths in FIGS. 4 and 5. It will be appreciated that both the driving amplifiers and the matching amplifiers may be constructed using alternative arrangements of bipolar transistors such as PNP bipolar transistors or NPN bipolar transistors. In a bipolar embodiment, biasing voltage sources 630 are replaced by biasing current sources. In addition, the RF feed network and these amplifiers may be constructed in either a single ended or differential fashion. DC lines may be arranged orthogonally to the RF distribution direction for isolation. In addition, this same orthogonality may be maintained for the RF transmit and receive networks in a full duplex design.

The integration of the CPW network and the distributed amplification into a wafer scale integrated antenna module (WSAM) may be better understood by classifying the WSAM into three layers. The first layer would be a semiconductor substrate, such as silicon. On a first surface of the substrate, antennas such as patches for the integrated antenna circuits are formed as discussed, for example, in U.S. Pat. No. 6,870,503, the contents of which are incorporated by reference herein. Active circuitry for the corresponding integrated antenna circuits that drive these antennas are formed on a second opposing surface of the substrate. The CPW transmission network is formed adjacent this second opposing surface. The second layer would include the antennas on the first side of the substrate whereas the third layer would include the CPW network. Thus, such a WSAM includes the "back side" feature disclosed in U.S. application Ser. No. 10/942,383, the contents of which are incorporated by reference, in that the active circuitry and the antennas are separated on either side of the substrate. In this fashion, electrical isolation between the active circuitry and the antenna elements is enhanced. Moreover, the ability to couple signals to and from the active circuitry is also enhanced. As discussed in U.S. Ser. No. 10/942,383, a heavily doped deep conductive junction through the substrate couples the active circuitry to vias/rods at the first substrate surface that in turn couple to the antenna elements. Formation of the junctions is similar to a deep diffusion junction process used for the manufacturing of double diffused CMOS (DMOS) or high voltage devices. It provides a region of low resistive signal path to minimize insertion loss to the antenna elements.

Upon formation of the junctions in the substrate, the active circuitry may be formed using standard semiconductor processes. The active circuitry may then be passivated by applying a low temperature deposited porous SiOx and a thin layer of nitridized oxide ($Si_xO_yN_z$) as a final layer of passivation. The thickness of these sealing layers may range from a fraction of a micron to a few microns. The opposing second surface may then be coated with a thermally conductive material and taped to a plastic adhesive holder to flip the substrate to expose the first surface. The substrate may then be back ground to reduce its thickness to a few hundreds of micrometers.

An electric shield may then be sputtered or alternatively coated using conductive paints on background surface. A shield layer over the electric field may form a reflective plane for directivity and also shields the antenna elements. In addition, parts of the shield form ohmic contacts to the junctions. For example, metallic lumps may be deposited on the junctions. These lumps ease penetration of the via/rods to form ohmic contacts with the active circuitry.

Figure 8:
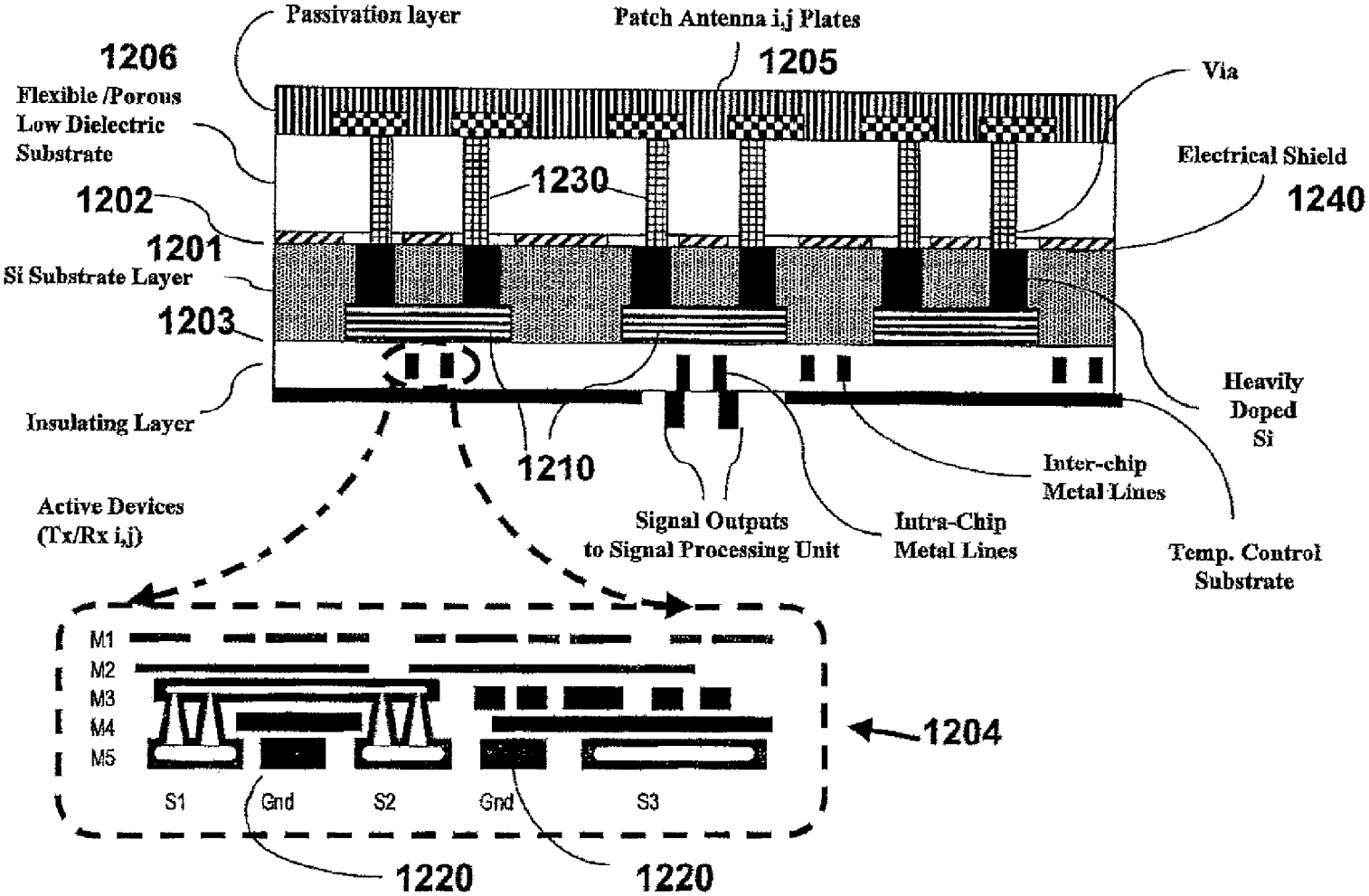
FIG. 8 is a cross-sectional view of an integrated antenna circuit having a coplanar waveguide RF feed network in accordance with an embodiment of the invention.

In an alternative embodiment, the CPW network may be integrated on the antenna side of the substrate. Because the backside approach has the isolation and coupling advantages described previously, the following discussion will assume without loss of generality that the RF feed network is integrated with the substrate in a backside embodiment. For example as seen in cross-section in FIG. 8, a semiconductor substrate 1201 has opposing surfaces 1202 and 1203. Antenna elements 1205 such as patches are formed on a dielectric layer 1206 adjacent to surface 1202. Active circuitry 1210 integrated with substrate 1201 includes the driving and matching amplifiers for an RF feed network 1204 having CPW conductors S1 and S2. Adjacent surface 1203, metal layer M1 includes inter-chip and other signal lines. Metal layer M2 forms, among other things, a ground plane for CPW conductors S1 and S2, which are formed in metal layer 5 as well as ground plates 1220. Metal layer M4 provides a connecting layer to couple CPW conductors together as necessary. The driving and matching amplifiers within active circuitry 1210 couple through vias (not illustrated) in apertures in the ground plane in metal layer M2 to CPW conductors S1 and S2. This active circuitry may also drive antennas 1205 through a plurality of vias 1230 that extend through the dielectric layer. An electric shield layer 1240 isolates the dielectric layer from surface 1202 of the substrate. The antennas may be protected from the elements and matched to free space through a passivation layer.

Figure 9:
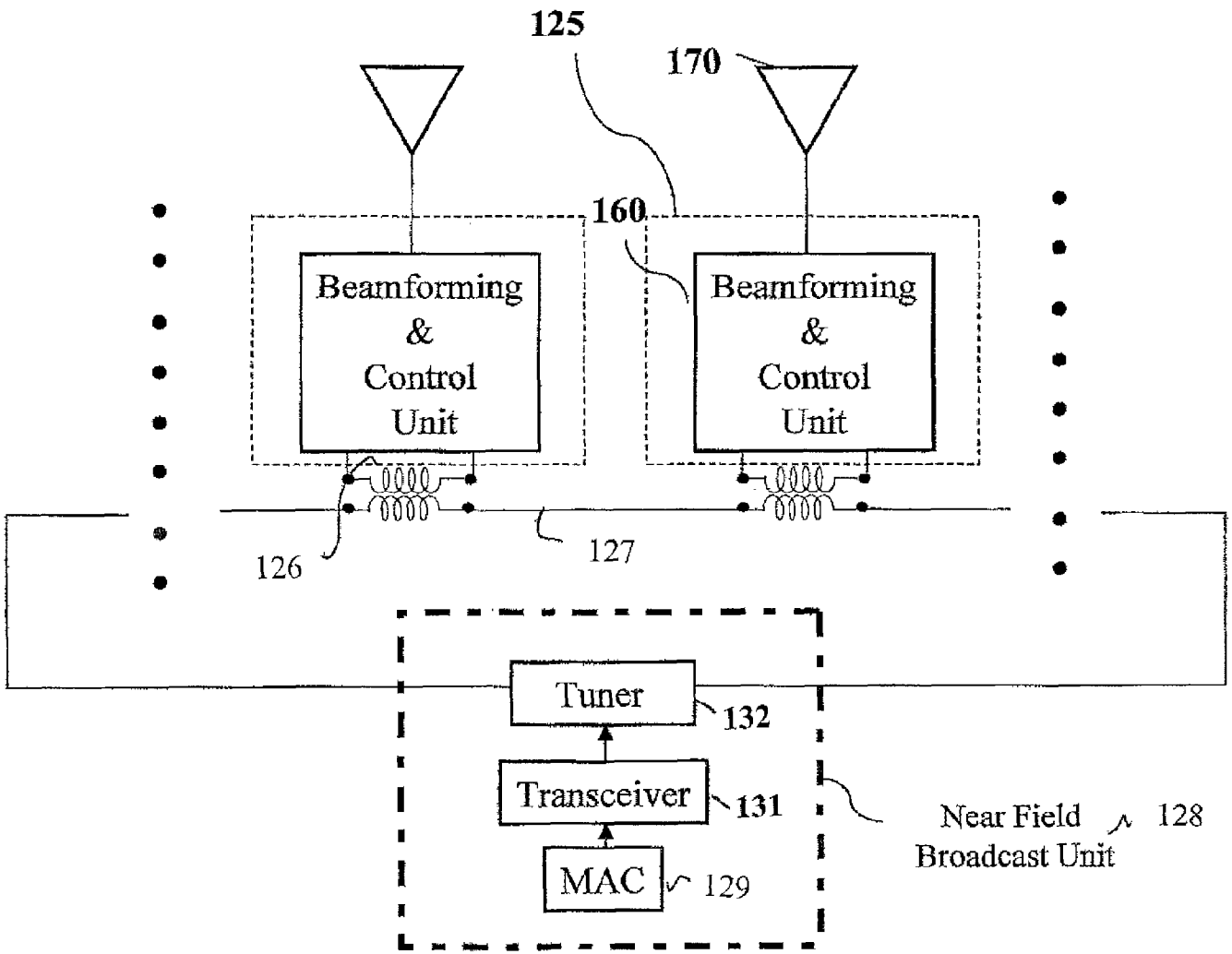
FIG. 9 is a schematic view of an array of integrated antenna circuits configured to receive beamforming commands through a near-field coupling between a coil and integrated inductors.

A coupling array mesh approach may be used to provide the control signals to controller 190 of FIGS. 2 and 3. For example, FIGS. 2 and 3 illustrate an internal waveguide antenna/receptor 206 that will be discussed below. In an alternative embodiment, receptors 206 are replaced by integrated inductors such as disclosed in U.S. Pat. No. 6,963,307. These coils would be formed in the semiconductor metal layers as discussed with regard to the CPW network illustrated in FIG. 8. A conceptual view of such a near-field coupling approach is illustrated in FIG. 9. Each integrated circuit 125 couples to an integrated inductor 126 that receives magnetic energy from a near-field coupling coil 127. The near-field coupling coil is driven by, for example, a near-field broadcast unit 128 that may include a media access control (MAC) processor 129, a transceiver 131, and a tuner 132.

Figure 10:
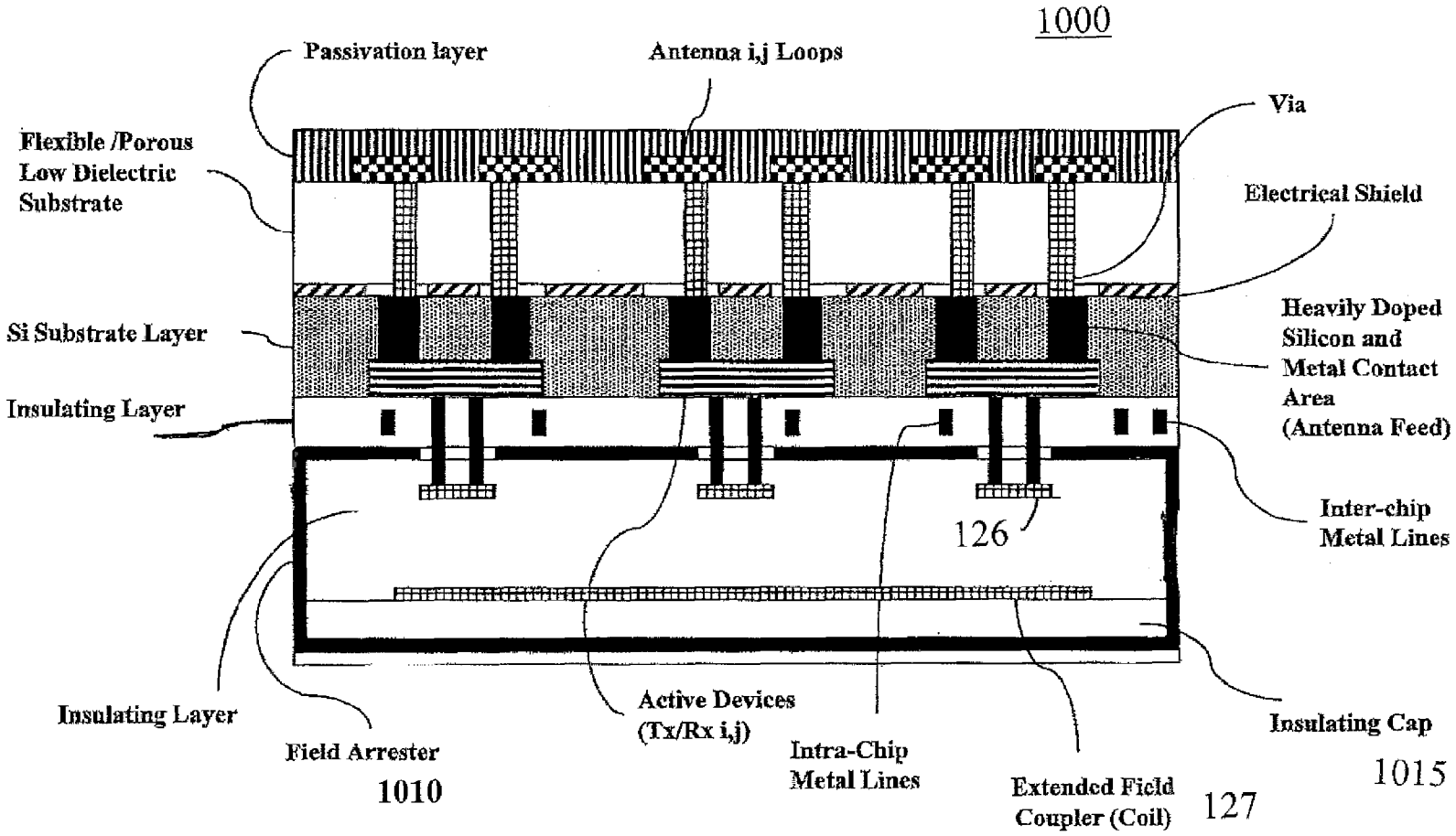
FIG. 10 is a cross-sectional view of a WSAM incorporating the integrated antenna circuits of FIG. 9.

Broadcast unit 128 may address each individual beamforming and control unit 160 using any suitable protocol. For example, beamforming and control units 160 may be considered to be arrayed in rows and columns. A given beamforming and control unit 160 could thus be addressed by its row and column address as encoded by the MAC processor in the near field broadcast unit. Regardless of how the addressing is performed, each RF beamforming and control unit may include a corresponding receiver and MAC processor (not illustrated) that decodes the received near-field signal from its integrated inductor. A similar receiver and MAC processor may be included in the beamforming and control unit 160 for reception of the beamforming commands from a waveguide receptor or from an antenna. Thus, not only is the address decoded, but the beam steering commands and any other additional commands such as gain instructions are also decoded by the beamforming and control unit 160. Moreover, data to be transmitted could also be encoded and transmitted from broadcast unit 128 and then received and decoded by the RF beamforming and control units 160. Referring now to FIG. 10, a WSAM 1000 having integrated inductors 126 (which are simplified for illustration clarity) is illustrated in cross section. This cross section has the same general structure as discussed with regard to FIG. 8. However, the CPW network on the backside of the substrate is not shown in FIG. 10 for illustration clarity. To provide shielding, integrated inductors 126 and near field coil 127 of FIG. 9 are surrounded by a conductive field arrester shield 1010. An insulating cap 1015 isolates coil 127 from the field arrester.

Figure 11:
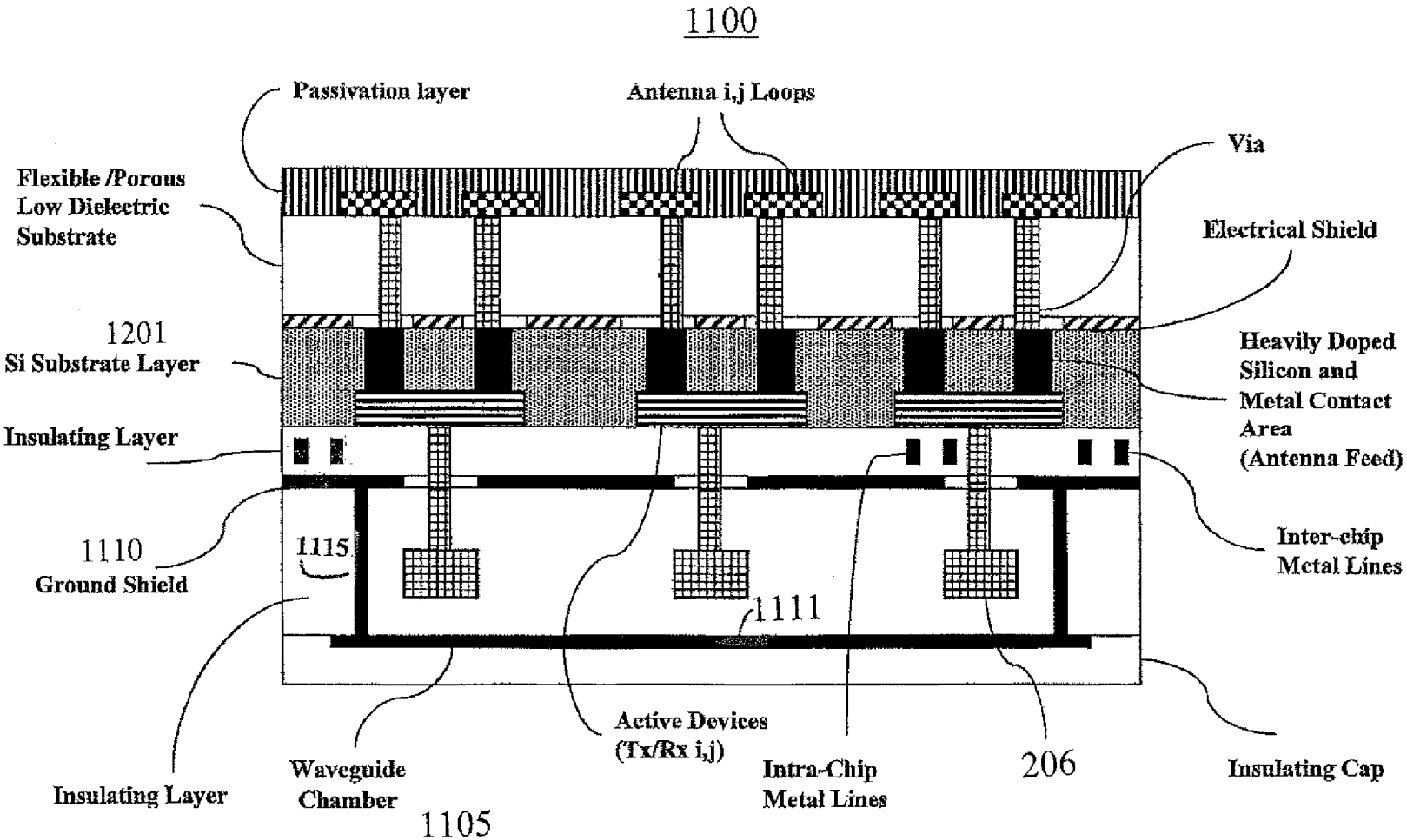
FIG. 11 is a cross-sectional view of a WSAM in which the integrated antenna circuits receive beamforming commands through a near-field coupling with receptors in a waveguide.

As an alternative near-field coupling approach, beamforming and other commands may be transmitted to the RF beamforming units 160 using an integrated circuit waveguide such as discussed in U.S. application Ser. No. 11/536,625. FIG. 11 illustrates a WSAM 1100 including an integrated waveguide 1105. Receptors such as a T-shaped monopole 206 (also illustrated in FIGS. 2 and 3) transmit and/or receive beamforming commands and other information through waveguide 1105. Waveguide 1105 is constructed using a top metal plate/ground shield 1110 and a bottom metal plate 1111 that are formed in corresponding metal layers of the semiconductor process used to form the active devices in substrate 1201. The walls of waveguide 1105 are formed using conductor-filled vias 1115 that connect between plates 1110 and 1111. The use of a T-shaped element for 206 results in a transverse electric (TE) mode of propagation through waveguide 1105. Alternative configurations result in a transverse magnetic (TM) mode of propagation.

Figure 12:
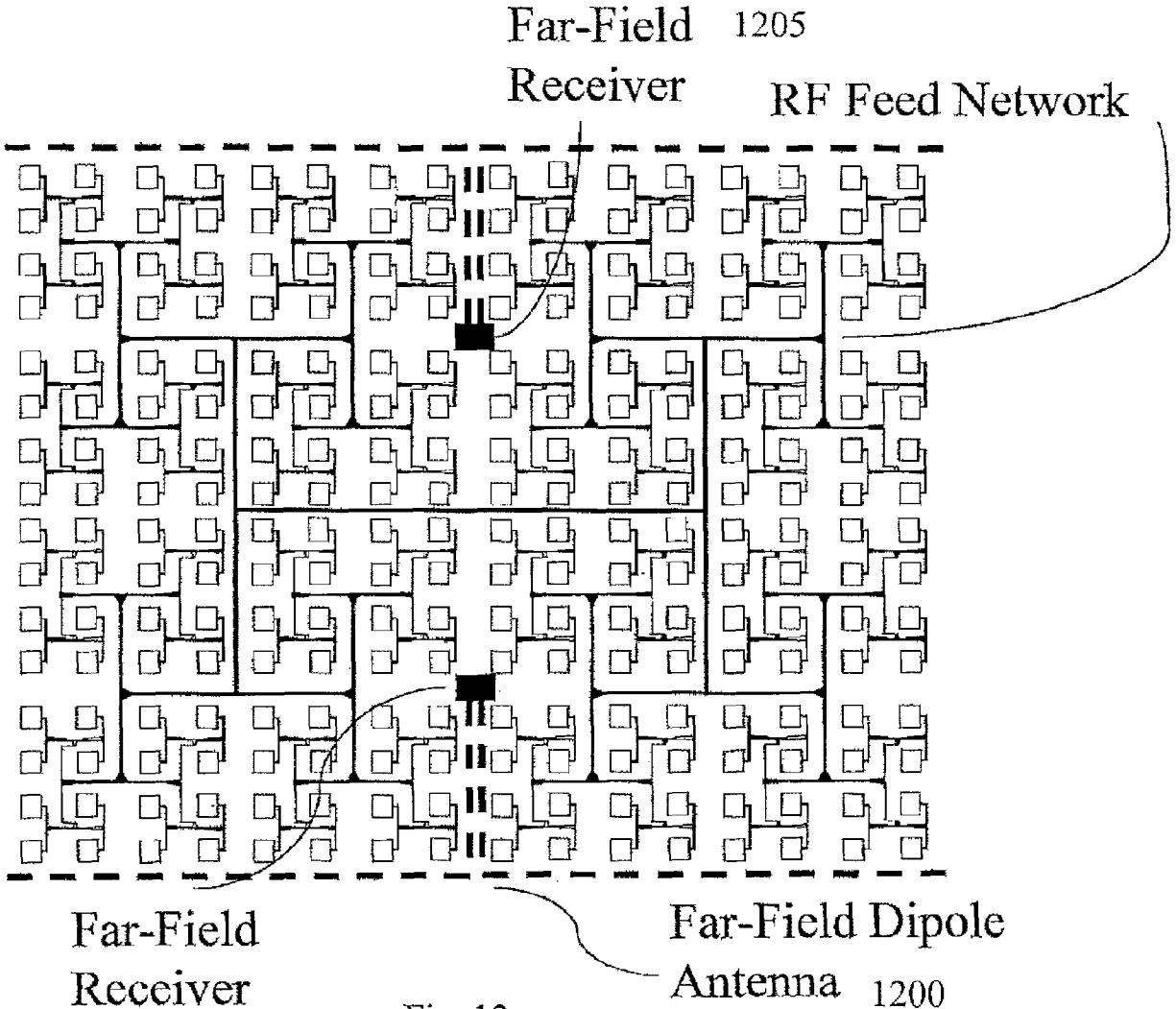
FIG. 12 is a plan view of a WSAM antenna array that includes a second plurality of antennas for receiving beamforming commands.

The advantage of near-field propagation of the beamforming commands to the beamforming units 160 is that there is a strong isolation between the signals used to encode the commands versus the signals actually transmitted or received by antennas 170. Moreover, the near field receptors are further isolated through the "backside" integrations illustrated in FIGS. 10 and 11. However, it will be appreciated that the commands may also be received in the far-field through the use of receptor antennas arranged among antennas 170. For example, consider the H array of patch antennas illustrated in FIG. 12 that are arranged as discussed with regard to FIGS. 4 and 5. However, a plurality of lower-frequency dipole antennas 1200 may also be integrated onto the front side of the substrate as well. Dipoles 1200 communicate with far-field receivers 1205 in beamforming units 160 (not illustrated).

Figure 13:
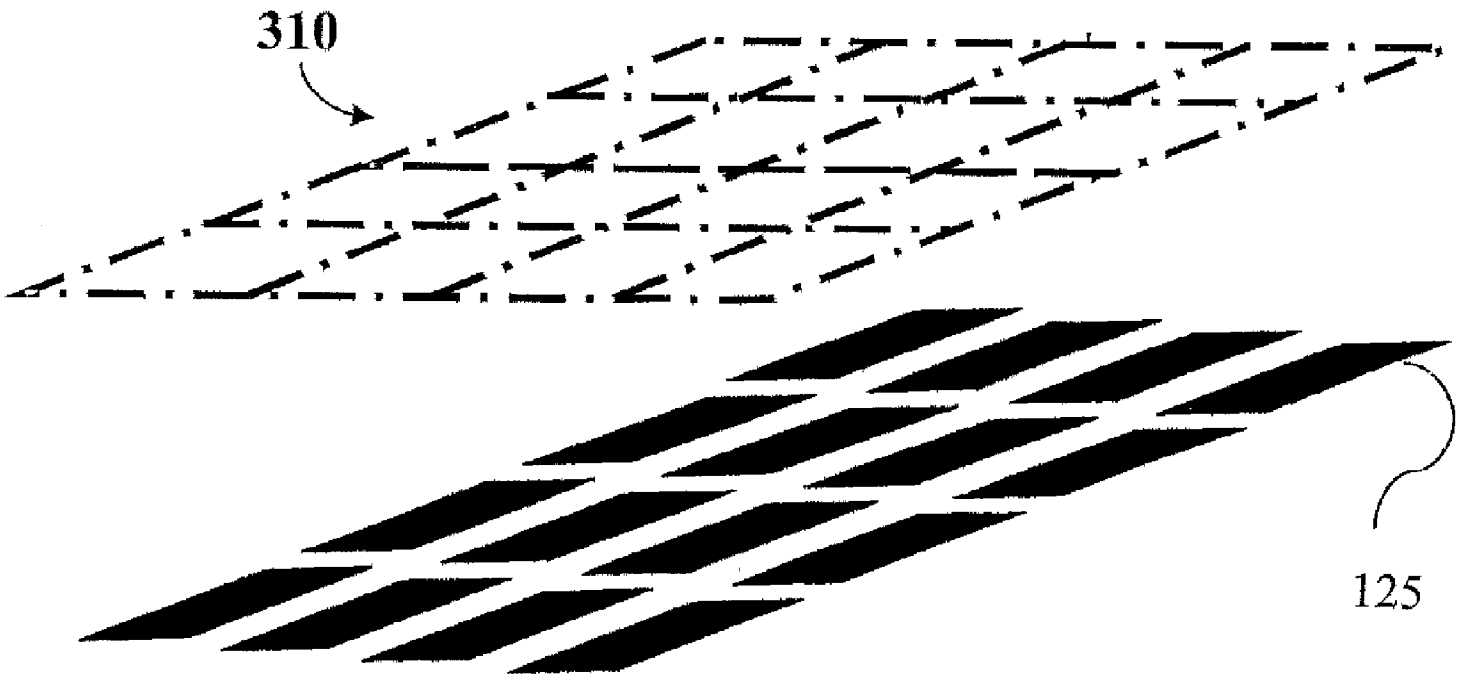
FIG. 13 is a conceptual view of a coupling array mesh providing commands to an array of integrated antenna circuits through either a near-field or far-field coupling.

Regardless of whether a near field or far field approach is used to transmit the beamforming commands, the encoding of this information may be in accordance with an suitable protocol. For example, time division multiplexing, code division multiple access, and other multiple access schemes such as Ethernet or Bluetooth may be implemented such that the various beamforming units may share the spectrum broadcast from the near field (or far field) broadcast unit. As the control signals are propagated through either a near field or far field coupling, the resulting control may be thought of as a mesh because, for example, the individual integrated antenna circuits may be addressed by row and column. The resulting "coupling array mesh" 310 is shown conceptually in FIG. 13. This mesh controls the beam steering and other functions of integrated antenna circuits 125 through either a near-field or far-field coupling as discussed previously.

Figure 14:
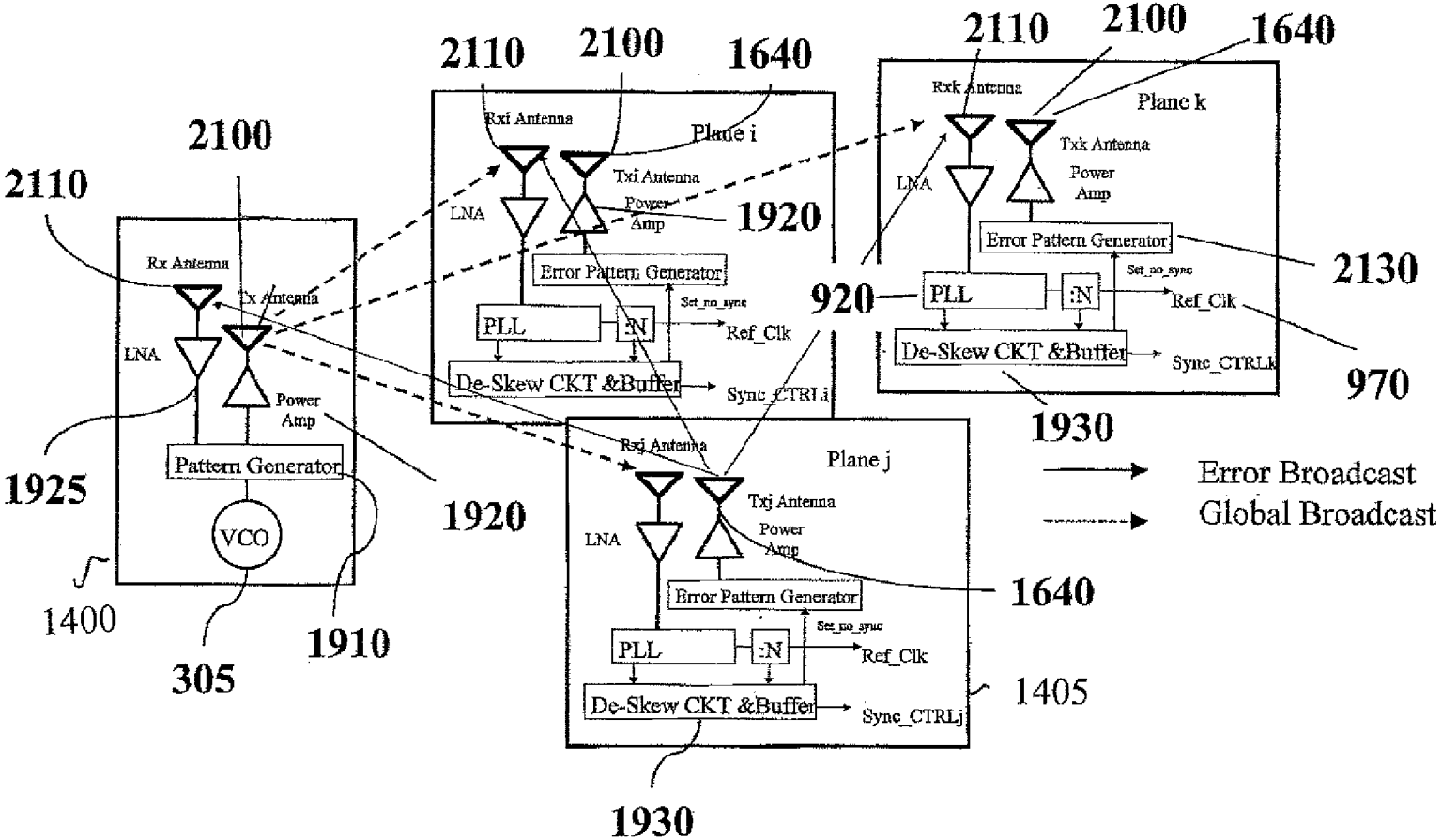
FIG. 14 is a block diagram of a master integrated antenna circuit and a plurality of slave integrated antenna circuits controlled through a coupling array mesh coupling.

A WSAM formed from integrated antenna circuits that include oscillators such as a phase-locked loop (PLL) also benefit from a near-field or far-field coupling of beam steering commands. For example, consider a master integrated antenna circuit 1400 illustrated in FIG. 14. It includes a transmitting antenna that transmits in either near-field or far-field to receiving antennas of slave integrated antenna circuits 1405. Master circuit 1400 includes a VCO 305, a pattern generator 1910, a receiving antenna 2110, a low noise amplifier (LNA) 1925, a transmitting antenna 2100, and a power amplifier 1920. In this fashion, master circuit 1400 can receive instructions from its receiving antenna 2110 and generate a modulated RF signal accordingly using VCO 305 and pattern generator 1910. The modulated RF signal is propagated to slave integrated antenna circuits 1405 after amplification in power amplifier 1920 and transmission from transmitting antenna 1640 (also denoted as antenna 2100).

Slave integrated antennas circuits include a PLL 920 that receives the modulated RF signal after reception in antenna 2110 and amplification in LNA 1925. An output signal from PLL 920 is processed through a frequency divider and a de-skew circuit and buffer 1930 before driving through power amplifier 1920 and transmitting antenna 2100. As discussed analogously with regard to FIG. 9, each slave integrated antenna circuit 1405 may include a MAC processor to extract beamforming commands from the modulated RF signal propagated from master integrated antenna circuit 1400. The resulting beamforming commands adjust the PLL feedback loop so as to provide the appropriate phase offset from the synchronizing signal they lock to as transmitted from the master integrated antenna circuit 1400. Should a slave integrated antenna circuit have its PLL out of lock, an error pattern generator 2130 transmits a desynchronizing signal to the remaining slave integrated antenna circuits as well as the master integrated antenna circuit so that the beamforming system may resynchronize. The propagation of the modulated RF signal from the master to the slaves may be accomplished using various near field and far field coupling array mesh embodiments such as those discussed analogously with regard to FIGS. 9 through 12.

It will be obvious to those skilled in the art that various changes and modifications may be made without departing from this invention in its broader aspects. The appended claims encompass all such changes and modifications as fall within the true spirit and scope of this invention.

I claim:

1. An integrated circuit antenna array, comprising:

a substrate, a plurality of first antennas adjacent the a first side of the substrate; and an RF network adjacent a second side of the substrate, the RF feed network coupling to a distributed plurality of amplifiers integrated with the substrate and to a distributed plurality of phase-shifters also integrated with the substrate, each phase shifter being associated with a receptor to receive a beam-forming command, wherein each receptor is configured to receive the beam-forming command through either a near-field coupling or a far-field coupling.

2. The integrated circuit antenna array of claim 1, wherein each receptor comprises an integrated inductor formed in metal layers adjacent the second side of the substrate such that the beam-forming command is received through a near-field coupling with the integrated inductor.

3. The integrated circuit antenna array of claim 1, wherein each receptor comprises a second antenna arranged on the first side of the substrate such that the beam forming command is received through a far-field coupling with the second antenna.

4. The integrated antenna array of claim 1, wherein the RF feed network and the distributed plurality of amplifiers are configured to form a resonant network such that if a timing signal is injected into an input port of the RE network, the resonant network oscillates to provide a globally synchronized BY signal to each of the antennas.

5. The integrated circuit antenna array of claim 1, wherein the substrate is a semiconductor wafer substrate.

6. The integrated circuit antenna array of claim 1, wherein the RF feed network is implemented using waveguides selected from the group consisting of microstrip waveguides, coplanar waveguides, and planar waveguides.

7. The integrated circuit antenna array of claim 1, further comprising a waveguide adjacent the second surface of the substrate, wherein each receptor is a T-shaped antenna configured within the waveguide such that the beamforming command is received through a near-field coupling with the T-shaped antenna.

8. The integrated circuit antenna array of claim 7, wherein the waveguide is formed in metal layers adjacent the second side of the substrate.

9. An integrated circuit antenna array, comprising:

a semiconductor substrate having a first surface and an opposing second surface;

a plurality of heavily-doped contact regions extending from the first surface to the second surface;

a plurality of antennas formed on an insulating layer adjacent the first surface, each antenna being coupled to corresponding ones of the contact regions by vias;

driving circuitry formed on the second surface of the substrate, wherein the driving circuitry is configured such that each antenna corresponds to a oscillator, each oscillator being coupled to a receptor configured to receive a beamforming command through either a near-field coupling or a far-field coupling.

10. The integrated circuit antenna array of claim 9, wherein each receptor comprises an integrated inductor formed in metal layers adjacent the second side of the substrate such that the beam-forming command is received through a near-field coupling with the integrated inductor.

11. The integrated circuit antenna array of claim 9, wherein each receptor comprises a second antenna arranged on the first side of the substrate such that the beam forming command is received through a far-field coupling with the second antenna.

12. The integrated circuit antenna array of claim 9, wherein each oscillator comprises a phase-locked loop.

13. The integrated circuit antenna array of claim 9, wherein the substrate is a semiconductor wafer substrate.

14. The integrated circuit antenna array of claim 9, further comprising a waveguide adjacent the second surface of the semiconductor substrate, wherein each receptor is a T-shaped antenna configured within the waveguide such that the beamforming command is received through a near-field coupling with the T-shaped antenna.

15. The integrated circuit antenna array of claim 14, wherein the waveguide is formed in metal layers adjacent the second side of the substrate.

* * * * *